US005285725A

United States Patent [19]

Imamaki et al.

[11] Patent Number: 5,285,725

[45] Date of Patent: Feb. 15, 1994

[54] HEAT SENSITIVE STENCIL

[75] Inventors: Teruo Imamaki, Kasugai; Keiji Seo, Nagoya, both of Japan

[73] Assignee: Brother Kogyo Kabushiki Kaisha, Nagoya, Japan

[21] Appl. No.: 994,315

[22] Filed: Dec. 21, 1992

[30] Foreign Application Priority Data

Jan. 20, 1992 [JP] Japan ..... 4-1455
Feb. 18, 1992 [JP] Japan ..... 4-6505

[51] Int. Cl.[5] ..... B05C 17/06
[52] U.S. Cl. ..... 101/127.1; 101/128.21
[58] Field of Search ..... 101/125, 127.1, 128.21, 101/128.4, 333, 112, 108

[56] References Cited

U.S. PATENT DOCUMENTS 2,651,255 9/1953 Wallich ..... 101/127.1
3,138,094 6/1964 Johnson ..... 101/125
3,561,360 2/1971 Branfield ..... 101/350
4,142,464 3/1979 Ranch ..... 101/128.21
4,184,428 1/1980 Hosoya ..... 101/125
4,441,422 8/1993 Dreeben ..... 101/125

*Primary Examiner*—Edgar S. Burr
*Assistant Examiner*—Ren Yan
*Attorney, Agent, or Firm*—Oliff & Berridge

[57] ABSTRACT

To form a good perforation image and prevent oozing of the ink in the processing of plate making, a heat sensitive stencil 10 is generally made of a heat sensitive film 12, a non-woven fabric 16 impregnated with ink, a separator 14, a frame 18 located so as to surround the non-woven fabric 16, and a film 20 as a base having an ink impermeability. The separator 14 is located between the heat sensitive film 12 and the non-woven fabric 16. An end portion of the separator 14 is inserted through a slit 18c of the frame 18, and extends through between the frame 18 and the film 20 to the outside of the heat sensitive stencil 10.

20 Claims, 9 Drawing Sheets

HEAT SENSITIVE STENCIL

BACKGROUND OF THE INVENTION

1. Field of the Invention

The present invention relates to a heat sensitive stencil.

2. Description of the Related Art

Conventionally known is a heat sensitive stencil paper which can be perforated by infrared radiation or a thermal head. A typical example of such a heat sensitive stencil paper is formed by bonding a thermoplastic film and a porous thin paper to each other with use of an adhesive. An example of a stencil printing device employing such a heat sensitive stencil paper is a known single drum type stencil printing device as shown in FIG. 10. Referring to FIG. 10, reference numeral 62 denotes a carrier drum. A perforated heat sensitive stencil paper 64 is wrapped around an outer circumferential surface of the carrier drum 62 in such a manner that a porous carrier of the heat sensitive stencil paper 64 is disposed inside. Ink is supplied from the inside of the carrier drum 62 toward the outer circumferential surface of the carrier drum 62. A press roller 66 is brought into pressure contact with the heat sensitive stencil paper 64 on the carrier drum 62 through a printing paper 68, and the carrier drum 62 is rotationally driven to thereby effect steneil printing on the printing paper 68.

However, the single drum type stencil printing device as mentioned above is large in scale, and it is intended to produce a large amount of prints. Accordingly, in the case of producing a relatively small amount of prints by using this printing device, a running cost is increased.

Another example of a stencil printing device is a known depression type stencil printing device as shown in FIG. 11. Referring to FIG. 11, reference numeral 70 denotes a heat sensitive stencil paper formed by bonding a thermoplastic film to a porous carrier. A frame 72 is provided at an outer peripheral portion of the porous carrier of the heat sensitive stencil paper 70. A cover sheet 74 having an ink impermeability is disposed on the frame 72 to define a recess 84 which is an ink applied portion. Thus, the heat sensitive stencil paper 70, the frame 72 and the cover sheet 74 constitute a heat sensitive stencil 76. The printing device is made of a depression member 78 adapted to be pivotally moved, a base member 80 disposed in opposed relationship to the depression member 78, and a retainer member 82 disposed at an outer peripheral portion of the depression member 78 opposed to the base member 80, for retaining the heat sensitive stencil 76. In operation, ink is first applied to the recess 84 defined by the perforated heat sensitive stencil paper 70 and the frame 72, and the cover sheet 74 is attached to the frame 72 so as to cover the recess 84, thus constructing the heat sensitive stencil 76. Then, the heat sensitive stencil 76 is secured to the depression member 78 by the retainer member 82, and the depression member 78 is pivotally depressed against a printing paper 86 placed on the base member 80.

The depression type stencil printing device as mentioned above can be made compact, but an operator must manually apply the ink. Accordingly, there is a possibility that the operator's hands or the like are stained by the ink in applying the same, or an ink layer thickness is not uniform, causing nonuniformity of print.

SUMMARY OF THE INVENTION

The present invention has been accomplished to solve the above and other problems, and it is an object of the present invention to provide a heat sensitive stencil which can form a good perforation image and prevent spreading of the ink in the process of plate making.

To achieve the above and other objects, a heat sensitive stencil, according to the present invention, having a laminate structure includes a heat sensitive film formed by bonding a thermoplastic film to a first porous carrier, a second porous carrier disposed on the side of the first porous carrier of the heat sensitive film and impregnated with ink, a base having an ink impermeability, and a separator disposed between the first porous carrier and the second porous carrier such that the separator can be pulled away from the heat sensitive stencil.

In the heat sensitive stencil according to the present invention, the thermoplastic film is thermally perforated by a plate making apparatus to form a perforation image on the heat sensitive stencil. Thereafter, the heat sensitive stencil is attached to a stamp member, and the separator is completely pulled away from the heat sensitive stencil. Then, the stamp member is pressed against a printing paper, thereby squeezing the ink impregnated in the second porous carrier through the perforated portion of the heat sensitive stencil to effect stencil printing on the printing paper.

According to the present invention, it is featured that a separator is disposed between the first porous carrier and the second porous carrier so that the separator can be pulled away from the heat sensitive stencil. Accordingly, the ink is prevented from running from the perforated portion of the heat sensitive film in the process of plate making, so that it is unnecessary to provide a cleaning member in a plate making apparatus. Further, it is also unnecessary to carry out wasteful printing for removing the ink from the stamp surface of the heat sensitive stencil after the process of plate making.

BRIEF DESCRIPTION OF THE DRAWINGS

There will now be described preferred embodiments of the present invention with reference to the following figures wherein.

DETAILED DESCRIPTION OF PREFERRED EMBODIMENTS

A first preferred embodiment of the present invention will now be described with reference to FIGS. 1, 2, 5 and 6.

Figure 1:
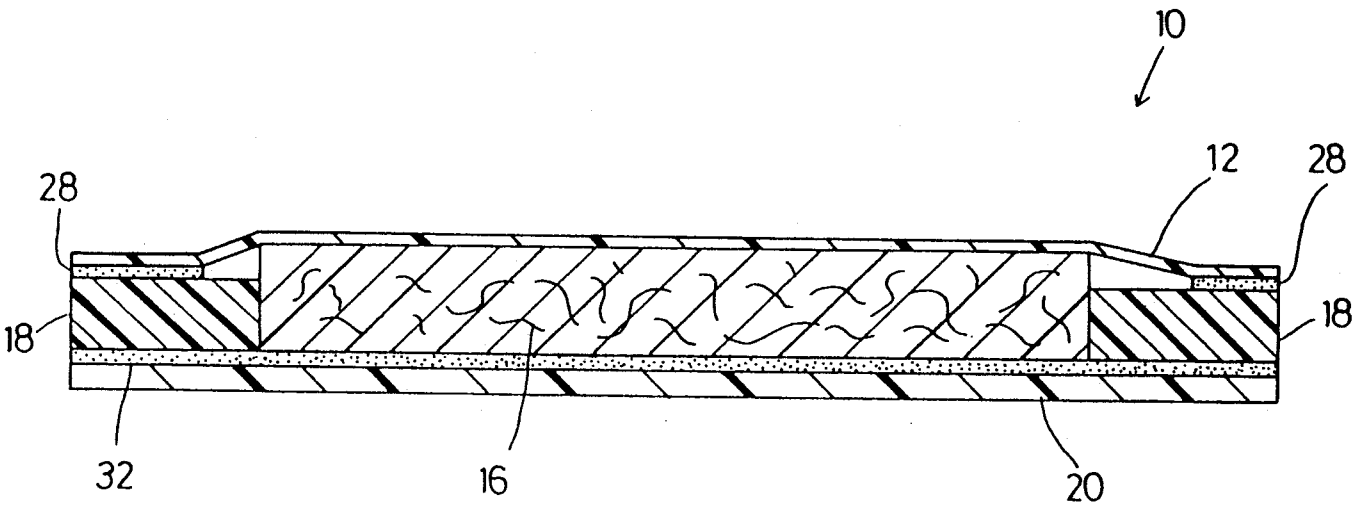
FIG. 1 is a side sectional view of a heat sensitive stencil in a first preferred embodiment according to the present invention.
Figure 2:
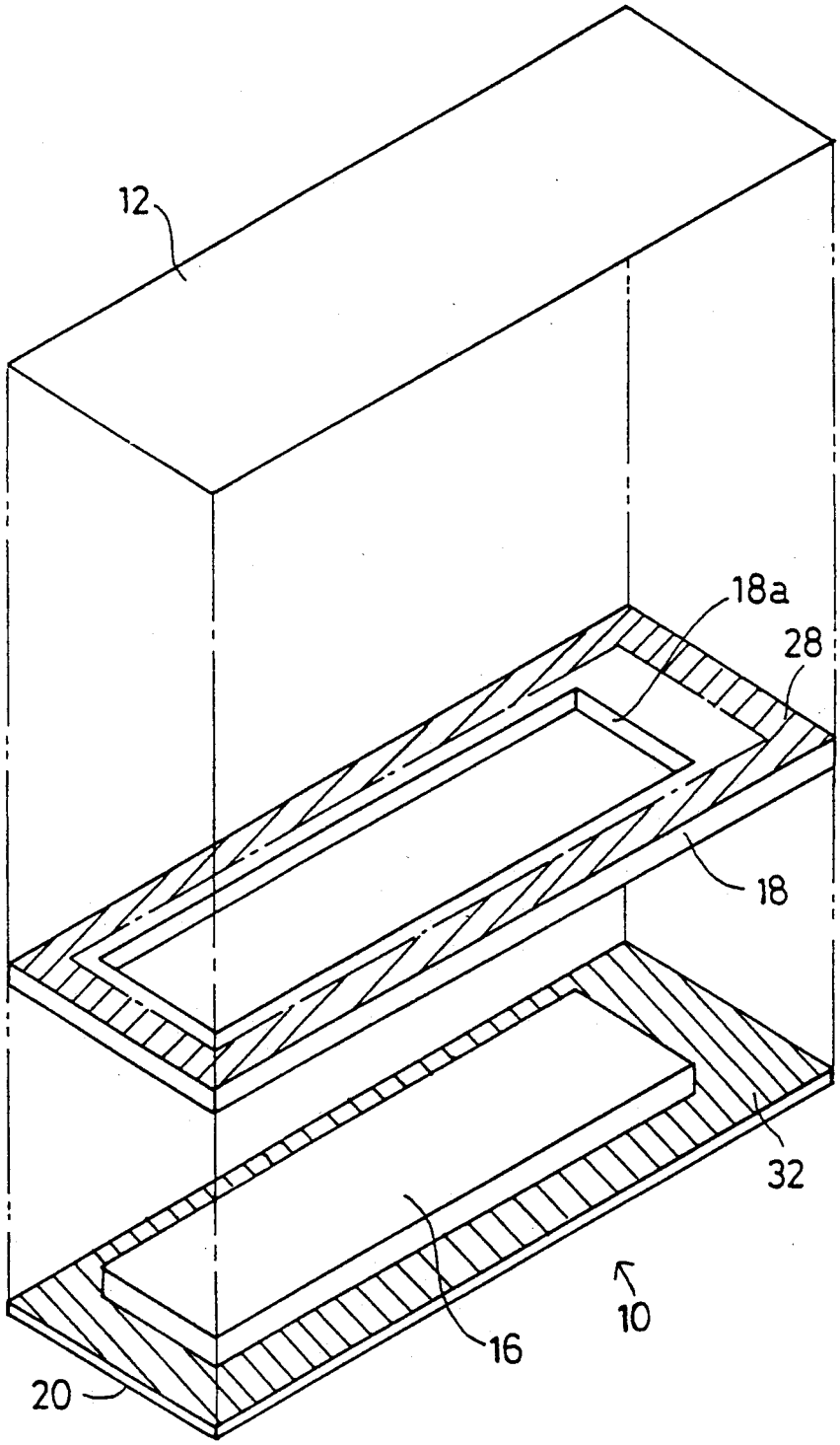
FIG. 2 is an exploded perspective view of the heat sensitive stencil in the first preferred embodiment.

FIG. 1 is a sectional view of a heat sensitive stencil 10 in the first preferred embodiment, and FIG. 2 is an exploded perspective view of the heat sensitive stencil 10 in the first preferred embodiment. The heat sensitive stencil 10 shown in FIGS. 1 and 2 is generally made of a heat sensitive film 12, a non-woven fabric 16 impregnated with ink, a frame 18 located so as to surround the non-woven fabric 16, and a film 20 as a base having an ink impermeability.

Figure 5:
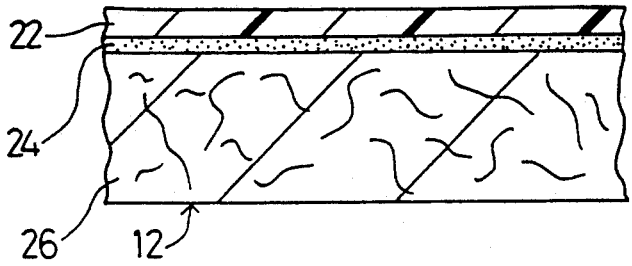
FIG. 5 is a partial side sectional view of a heat sensitive film constituting the heat sensitive stencil according to the present invention.

As shown in FIG. 5, the heat sensitive film 12 is made of a thermoplastic film 22, a porous carrier 26, and an adhesive layer 24 bonding them together. In this preferred embodiment, the thermoplastic film 22 is preferably formed from a polyethylene terephthalate film (which will be hereinafter referred to as a "PET film") having a thickness of about 2 μm. However, the film 22 may be made of any suitable thermoplastic material such as polypropylene or vinylidene chloride-vinyl chloride copolymer. The thickness of the PET film is preferably about 1–4 μm. If the thickness is less than about 1 μm, the manufacturing cost becomes high, and the strength becomes low, resulting in poor practical use. In contrast, if the thickness is more than about 4 μm, it is too thick to perforate the film with a general thermal head having a rated power of about 50 $mJ/mm^2$. The porous carrier 26 is preferably formed from a porous thin sheet of paper made primarily of a natural fiber such as Manila hemp, kozo or mitsumata, a synthetic fiber such as polyethylene terephthalate, polyvinyl alcohol or polyacrylonitrile, or a semi-synthetic fiber such as rayon. As shown in FIG. 2, the heat sensitive film 12 and the frame 18 are bonded together at their outer peripheral portions through an adhesive layer 28.

As shown in FIG. 2, the frame 18 is formed at its central portion with an opening 18*a* having a size corresponding to that of the non-woven fabric 16. The above-mentioned adhesive layer 28 is formed on an upper surface of the frame 18 at its outer peripheral portion (a hatched portion of the frame 18 shown in FIG. 2), so as to bond the heat sensitive film 12 to the frame 18. In this preferred embodiment, the ink impregnated in the non-woven fabric 16 is preferably oil based ink. Therefore, the frame 18 is formed of a material not to be eroded by the oil based ink, such as vinyl chloride, polypropylene, polyethylene, polyacetal, or polyethylene terephthalate.

The oil based ink is impregnated in the non-woven fabric 16 in a saturated condition, and the ink is allowed to ooze out by application of pressure to the non-woven fabric 16. The non-woven fabric 16 in this preferred embodiment is preferably formed from a synthetic fiber such as polyethylene, polypropylene, or polyethylene terephthalate. The thickness of the non-woven fabric 16 is set to preferably about ½ to 3 times that of the frame 18. If the thickness of the non-woven fabric 16 is too small, the heat sensitive film 12 comes into the inside of the frame 18 and cannot contact a thermal head in the process of plate making, so that the heat sensitive film 12 cannot be perforated by the thermal head. In contrast, if the thickness of the non-woven fabric 16 is too large, the non-woven fabric 16 protrudes from the frame 18 even when compressed by the pressure of the thermal head in the process of plate making. In this condition, the heat sensitive stencil 10 cannot be properly fed with the frame 18. Therefore, there occurs non-uniformity of a feed pitch or oblique feeding of the heat sensitive stencil 10 due to variations in thickness of the non-woven fabric 16 in the process of plate making. In view of the above possibility, it is preferable that the thickness of the non-woven fabric 16 is set to be the same as the thickness of the frame 18 when the non-woven fabric 16 is compressed by the pressure of the thermal head in the process of plate making.

An adhesive layer 32 is formed on an entire upper surface of the base film 20, so as to bond the frame 18 and the non-woven fabric 16 to the base film 20. The base film 20 in this preferred embodiment is preferably formed of a resin material not to be eroded by the oil based ink impregnated in the non-woven fabric 16, such as vinyl chloride, polypropylene, polyethylene, or polyethylene terephthalate.

In operation, the heat sensitive stencil 10 mentioned above is applied to a plate making apparatus (not shown) to form a perforation image on the heat sensitive stencil 10. That is, in the plate making apparatus, the thermoplastic film 22 of the heat sensitive film 12 is heated to be molten by the thermal head in accordance with print information to form the perforation image as a mirror image on the heat sensitive stencil 10. In the process of plate making, the thermal head comes into contact with the heat sensitive stencil 10 under a predetermined pressure. In this preferred embodiment, the heat sensitive stencil 10 includes the frame 18 located around the non-woven fabric 16 between the heat sensitive film 12 and the base film 20. Accordingly, the heat sensitive stencil 10 can ensure a strength sufficient to avoid the oblique feeding in pressure contact with the thermal head in the process of plate making, thereby obtaining a good perforation image. Furthermore, since the non-woven fabric 16 is surrounded by the frame 18, the ink impregnated in the non-woven fabric 16 is prevented from flowing from the outer periphery of the heat sensitive stencil 10 in the process of plate making.

Figure 6:
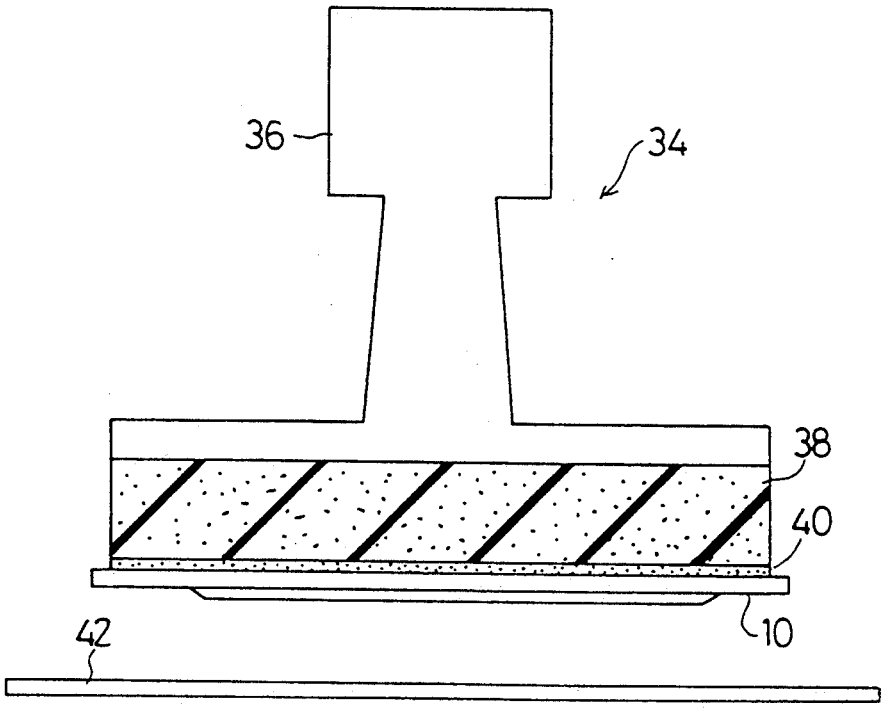
FIG. 6 is a side partial sectional view of a stamp member on which the heat sensitive stencil according to the present invention is attached.

The heat sensitive stencil 10, after the process of plate making, is attached to a stamp member 34 as shown in FIG. 6. The stamp member 34 is made of a grip portion 36, a cushion layer 38, and a cohesive layer 40. The base film 20 of the heat sensitive stencil 10 adheres to the cohesive layer 40 of the stamp member 34. In this condition, when the stamp member 34 is pressed against a printing paper 42, the non-woven fabric 16 of the heat sensitive stencil 10 is compressed, and the ink impregnated in the non-woven fabric 16 is therefore oozed from the perforated portion of the stamp surface. The ink thus oozed is transferred to the printing paper 42 to thereby form an image on the printing paper 42, where the image corresponds to the perforation image formed on the heat sensitive stencil 10.

Figure 3:
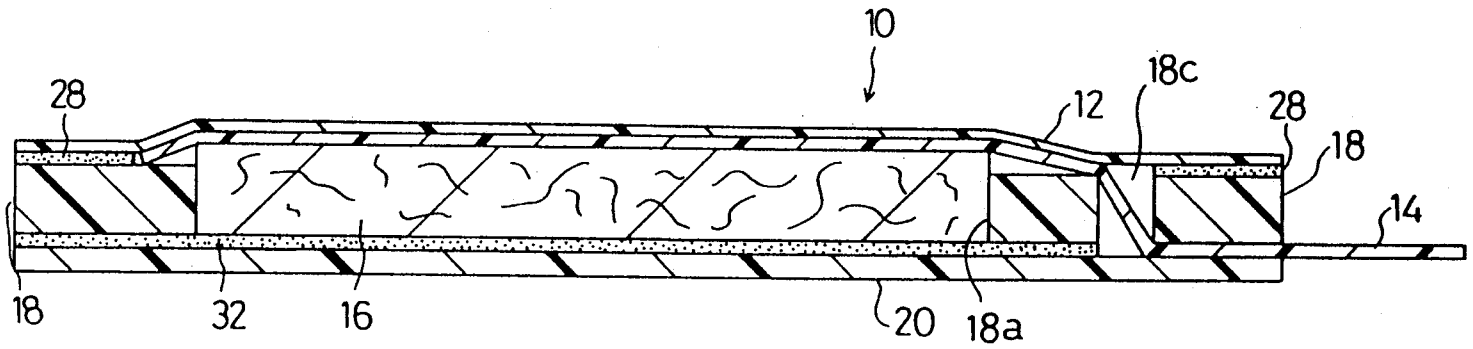
FIG. 3 is a side sectional view of a heat sensitive stencil in a second preferred embodiment according to the present invention.
Figure 4:
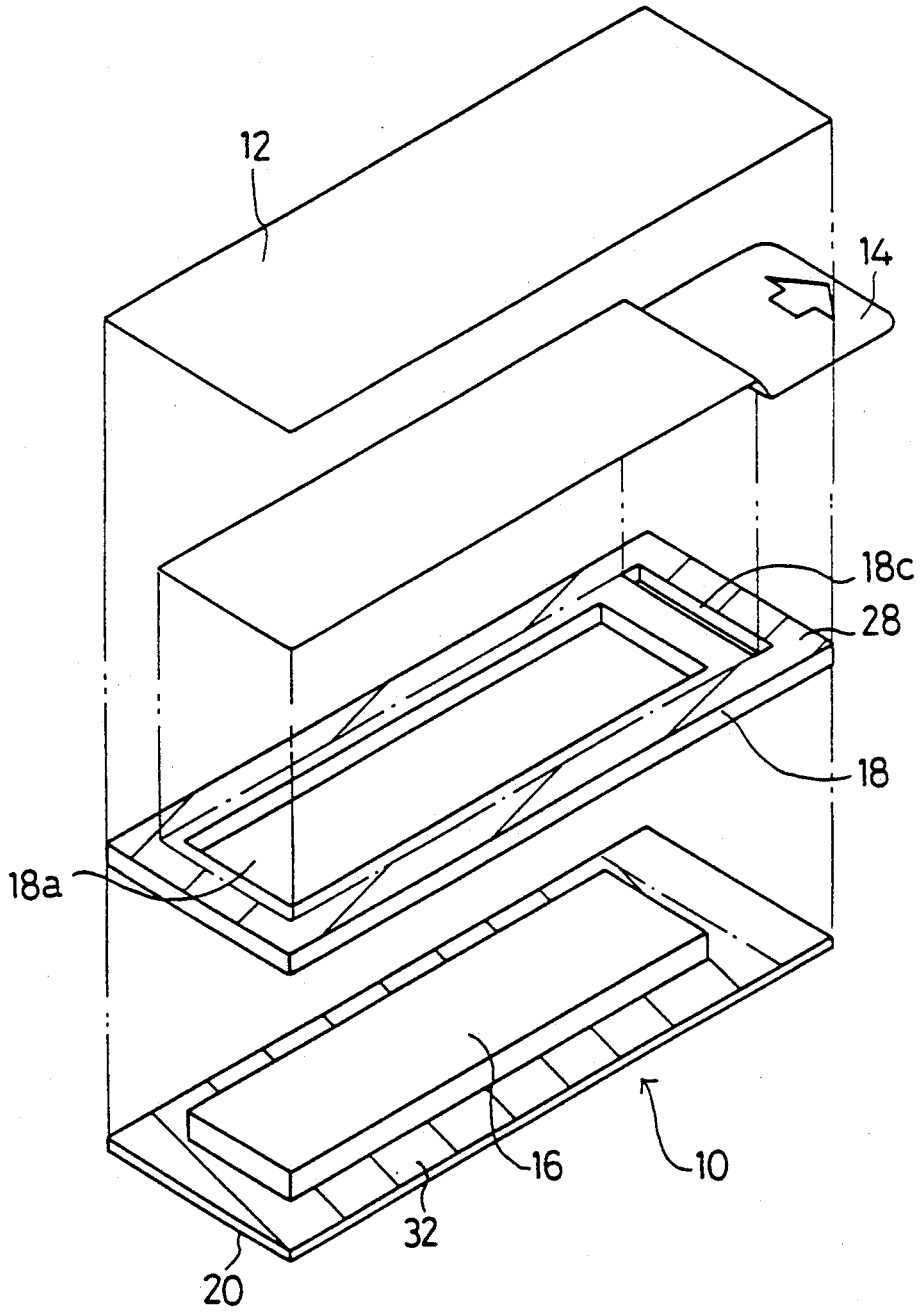
FIG. 4 is an exploded perspective view of the heat sensitive stencil in the second preferred embodiment.

A second preferred embodiment of the present invention will now be described with reference to FIGS. 3 to 6. FIG. 3 is a sectional view of a heat sensitive stencil 10 in the second preferred embodiment, and FIG. 4 is an exploded perspective view of the heat sensitive stencil 10 in the second preferred embodiment. The heat sensitive stencil 10 shown in FIGS. 3 and 4 is generally constituted of a heat sensitive film 12, a non-woven fabric 16 impregnated with ink, a separator 14, a frame 18 located so as to surround the non-woven fabric 16, and a film 20 as a base having an ink impermeability.

As shown in FIG. 5, the heat sensitive film 12 is made of a thermoplastic film 22, a porous carrier 26, and an adhesive layer 24 bonding them together. In this preferred embodiment, the thermoplastic film 22 is preferably formed from a polyethylene terephthalate film (which will be hereinafter referred to as a "PET film") having a thickness of about 2 μm. However, the film 22 may be made of any suitable thermoplastic material such as polypropylene or vinylidene chloride-vinyl chloride copolymer. The thickness of the PET film is preferably about 1–4 μm. If the thickness is less than about 1 μm, a manufacturing cost becomes high, and a strength becomes low, resulting in poor practical use. In contrast, if the thickness is more than about 4 μm, it is too thick to perforate the film with a general thermal head having a rated power of about 50 mJ/mm$^2$. The porous carrier 26 is preferably formed from a porous thin sheet of paper made primarily of a natural fiber such as Manila hemp, kozo or mitsumata, a synthetic fiber such as polyethylene terephthalate, polyvinyl alcohol or polyacrylonitrile, or a semi-synthetic fiber such as rayon. As shown in FIG. 4, the heat sensitive film 12 and the frame 18 are bonded together at their outer peripheral portions through an adhesive layer 28.

As shown in FIG. 4, the frame 18 is formed at its central portion with an opening 18*a* having a size corresponding to that of the non-woven fabric 16. Further, the frame 18 is formed at its right end portion (as viewed in FIG. 4) with a slit 18*c* through which the separator 14 is inserted so as to be pulled away. The above-mentioned adhesive layer 28 is formed on an upper surface of the frame 18 at its outer peripheral portion (a hatched portion of the frame 18 shown in FIG. 4), so as to bond the heat sensitive film 12 to the frame 18. In this preferred embodiment, the ink impregnated in the non-woven fabric 16 is preferably oil based ink. Therefore, the frame 18 is formed of a material not to be eroded by the oil based ink, such as vinyl chloride, polypropylene, polyethylene, polyacetal, or polyethylene terephthalate.

The oil based ink is impregnated in the non-woven fabric 16 in a saturated condition, and the ink is allowed to ooze out by application of pressure to the non-woven fabric 16. The non-woven fabric 16 in this preferred embodiment is formed from a synthetic fiber such as polyethylene, polypropylene, or polyethylene terephthalate. A thickness of the non-woven fabric 16 is set to preferably ½ to 3 times that of the frame 18. If the thickness of the non-woven fabric 16 is too small, the heat sensitive film 12 comes into the inside of the frame 18 and cannot contact a thermal head in the process of plate making, so that the heat sensitive film 12 cannot be perforated by the thermal head. In contrast, if the thickness of the non-woven fabric 16 is too large, the non-woven fabric 16 protrudes from the frame 18 even when compressed by the pressure of the thermal head in the process of plate making. In this condition, the heat sensitive stencil 10 cannot be properly fed by the frame 18. Therefore, there occurs nonuniformity of a feed pitch or oblique feeding of the heat sensitive stencil 10 due to variations in thickness of the non-woven fabric 16 in the process of plate making. In view of the above possibility, it is preferable that the thickness of the non-woven fabric 16 is set to be the same as the thickness of the frame 18 when the non-woven fabric 16 is compressed by the pressure of the thermal head in the process of plate making.

The separator 14 is located between the heat sensitive film 12 and the non-woven fabric 16. An end portion of the separator 14 is inserted through the slit 18*c* of the frame 18, and extends through between the frame 18 and the film 20 to the outside of the heat sensitive stencil 10.

More specifically, referring to FIG. 4, an inside area of the frame 18 as surrounded by a one-dot chain line is a covering area where the non-woven fabric 16 is covered with the separator 14. The separator 14 in this preferred embodiment is formed from a releasing paper preferably treated with silicone on a wood free paper or a glassine paper, or a resin film such as polyethylene terephthalate or tetrafluoroethylene (Teflon, a trade name), for example. As for the demanded characteristic of the separator 14, it is preferable that the separator 14 has a low wettability to the oil based ink. More specifically, it is preferable that the separator 14 has a wetting angle of about 45 degrees or more. As known in the art, the wetting angle is typically the angle between the surface of a substrate, in this case the separator 14, and a tangent extending from the surface of the liquid taken at the point of contact of the liquid with the substrate. The wettability, characterized by the wetting angle, corresponds to the affinity between a liquid and substrate. Thus, for example, if a liquid "beads up" on a substrate, the wetting angle between the liquid and the substrate is large, and the wettability of the substrate is low. Conversely, if a substrate is easily wet, thus having a high wettability, the liquid will tend to spread over the surface of the substrate with a small wetting angle. In the case of using a releasing paper for the separator 14, it is preferable that the whole surface of the releasing paper rather than a single surface only thereof contacting the non-woven fabric 16 is to be treated with silicone. If the wettability is high, or the single surface only of the releasing paper is treated with silicone, the ink is spread up to the side of the heat sensitive film 12, causing a possibility that the ink is oozed from a perforated portion of the heat sensitive film 12 in the process of plate making.

An adhesive layer 32 is formed on an entire upper surface of the base film 20, so as to bond the frame 18 and the non-woven fabric 16 to the base film 20. The base film 20 in this preferred embodiment is preferably formed of a resin material not to be eroded by the oil based ink impregnated in the non-woven fabric 16, such as vinyl chloride, polypropylene, polyethylene, or polyethylene terephthalate.

In operation, the heat sensitive stencil 10 mentioned above is applied to a plate making apparatus (not shown) to form a perforation image on the heat sensitive stencil 10. That is, in the plate making apparatus, the thermoplastic film 22 of the heat sensitive film 12 is heated to be molten by the thermal head in accordance with print information to form the perforation image as a mirror image on the heat sensitive stencil 10. In the process of plate making, the thermal head comes to contact with the heat sensitive stencil 10 under a predetermined pressure. In this preferred embodiment, the separator 14 is interposed between the heat sensitive film 12 and the non-woven fabric 16. Accordingly, even when the thermoplastic film 22 of the heat sensitive film 12 is perforated by the thermal head, the ink is prevented from being oozed from the perforated portion of the thermoplastic film 22.

The heat sensitive stencil 10 after the process of plate making is attached to a stamp member 34 as shown in FIG. 6. The stamp member 34 is constituted of a grip portion 36, a cushion layer 38, and a cohesive layer 40. The base film 20 of the heat sensitive stencil 10 adheres to the cohesive layer 40 of the stamp member 34. Thereafter, the separator 14 is completely pulled away from the heat sensitive stencil 10. In this condition, when the stamp member 34 is pressed against a printing paper 42, the non-woven fabric 16 of the heat sensitive stencil 10 is compressed, and the ink impregnated in the non-woven fabric 16 is therefore oozed from the perforated portion of the stamp surface. The ink thus oozed is transferred to the printing paper 42 to thereby form an image on the printing paper 42, where the image corresponds to the perforation image formed on the heat sensitive stencil 10.

As described above, the separator 14 is interposed between the heat sensitive film 12 and the non-woven fabric 16 in the process of plate making. Accordingly, even when the thermoplastic film 22 of the heat sensitive film 12 is perforated by the thermal head, the ink impregnated in the non-woven fabric 16 is prevented from being oozed from the perforated portion of the thermoplastic film 22. Accordingly, in attaching the heat sensitive stencil 10 to the stamp member 34, there is no fear of operator's hands being stained by the ink. Furthermore, in the process of plate making, the thermal head is prevented from being stained by the ink. As a result, it is unnecessary to carry out wasteful printing for removing the ink to be deposited to the stamp surface of the heat sensitive stencil 10.

Finally, a third preferred embodiment of the present invention will now be described with reference to FIGS. 7 to 9.

In the third preferred embodiment, the same members as those in the first and second preferred embodiments will be denoted by the same reference numerals, and the explanation thereof will be omitted hereinafter. Further, since a printing method to a printing paper is also similar to that in the first and second preferred embodiments, the explanation thereof will be omitted hereinafter.

Figure 7:
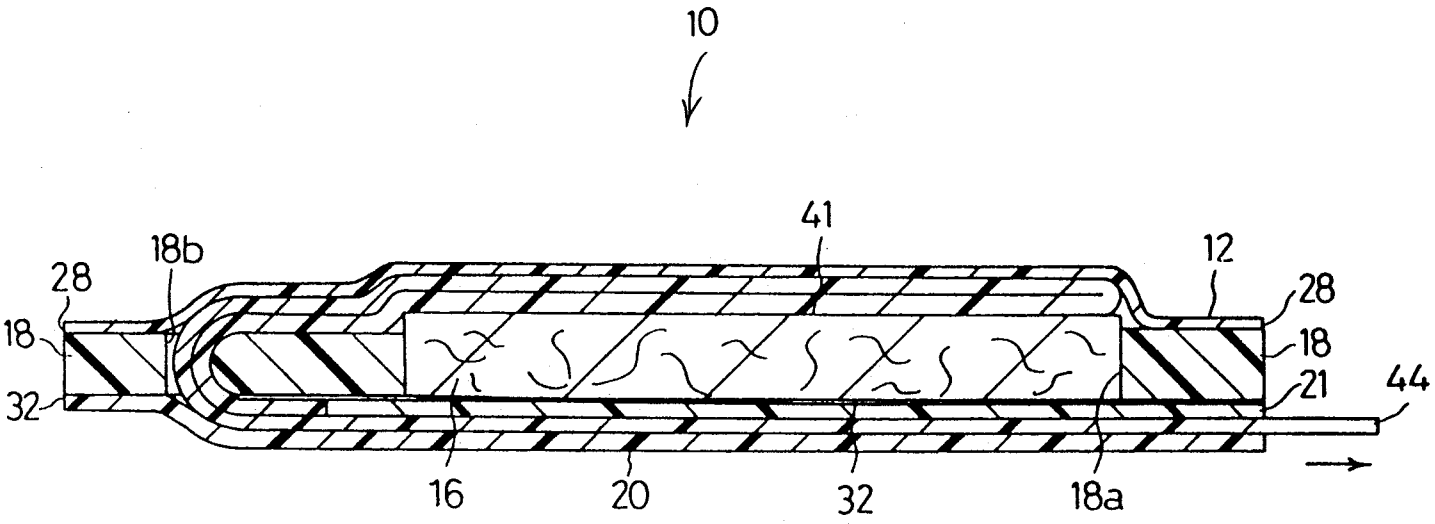
FIG. 7 is a side sectional view of a heat sensitive stencil in a third preferred embodiment according to the present invention.
Figure 9:
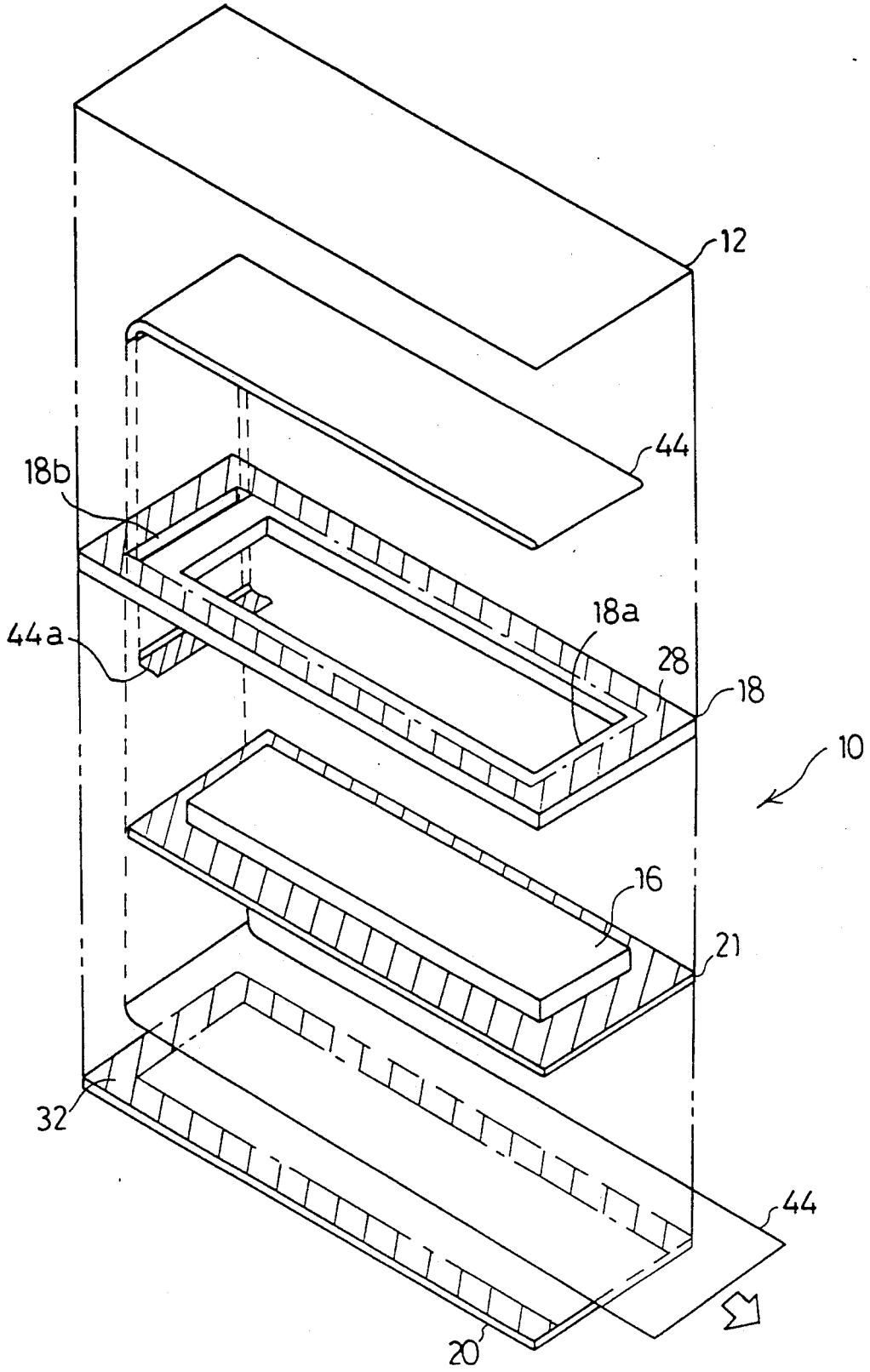
FIG. 9 is an exploded perspective view of the heat sensitive stencil in the third preferred embodiment.
Figure 10:
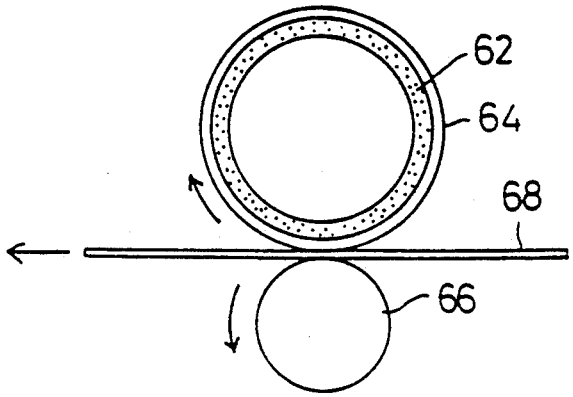
Fig.10 PRIOR ART
FIG. 10 is a sectional view of a single drum type stencil printing device in the related art.
Figure 11:
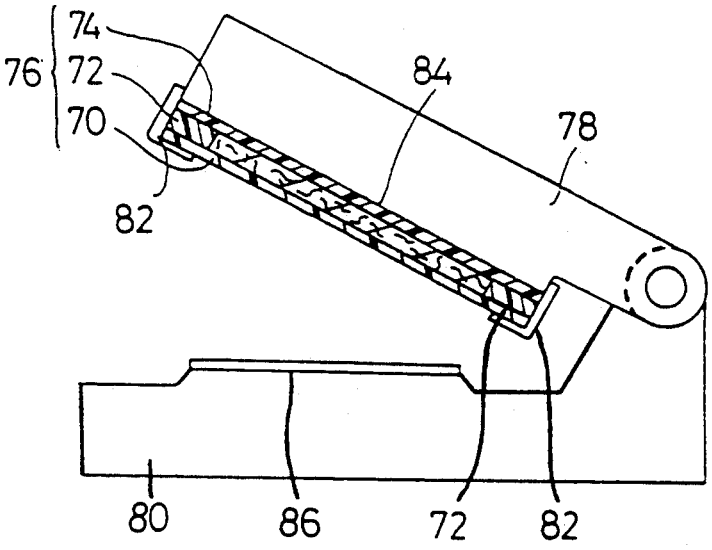
Fig.11 PRIOR ART
FIG. 11 is a sectional view of a depression type stencil printing device in the related art.

FIG. 7 is a sectional view of a heat sensitive stencil 10 in the third preferred embodiment, and FIG. 9 is an exploded perspective view of the heat sensitive stencil 10 in the third preferred embodiment. The heat sensitive stencil 10 shown in FIGS. 7 and 9 is generally constituted of a heat sensitive film 12, a separator 44, a non-woven fabric 16 impregnated with ink, a frame 18 located so as to surround the non-woven fabric 16, and two films 20 and 21 as a base having an ink impermeability.

As shown in FIG. 9, the heat sensitive film 12 and the frame 18 are bonded together at their outer peripheral portions through an adhesive layer 28. The frame 18 is formed at its central portion with an opening 18*a* having a size corresponding to that of the non-woven fabric 16. Further, the frame 18 is formed at its left end portion (as viewed in FIG. 9) with a slit 18*b* through which the separator 44 is inserted so as to be pulled away. Further, as shown in FIG. 7, the slit 18*b* is chamfered on the side of the opening 18*a*.

The oil based ink is impregnated in the non-woven fabric 16 in a saturated condition, and is allowed to ooze out by application of pressure to the non-woven fabric 16. The non-woven fabric 16 is fixed to an upper surface of the film 21.

An end portion 44*a* of the separator 44 (i.e., a hatched portion of the separator 44 shown in FIG. 9) is bonded through an adhesive layer 32 to a lower surface of the frame 18. The separator 44 extends from its fixed end portion 44*a* through the slit 18*b* of the frame 18 into a space between the heat sensitive film 12 and the non-woven fabric 16. The separator 44 is folded double in this space, and extends back through the slit 18*b* of the frame 18 and between the two films 20 and 21 to the outside of the heat sensitive stencil 10.

As shown in FIGS. 7 and 9, the film 20 is bonded through the adhesive layer 32 to the lower surfaces of the film 21 and the frame 18.

After forming a perforation image on the heat sensitive stencil 10 by using a plate making apparatus (not shown), the separator 44 is pulled to be removed from the space between the heat sensitive film 12 and the non-woven fabric 16. The operation of removing the separator 44 will now be described with reference to FIGS. 8(*a*) to 8(*c*).

Figure 8A:
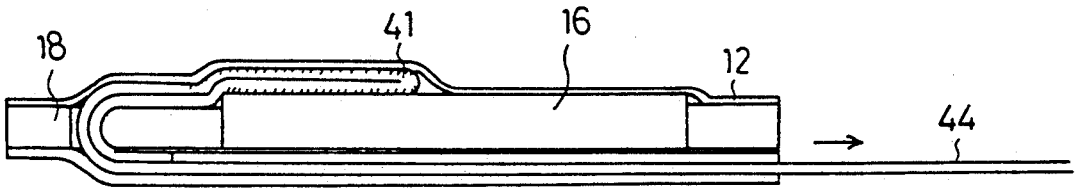
FIGS. 8(*a*) to 8(*c*) are side schematic views illustrating a separator removing operation in the third preferred embodiment.
Figure 8:
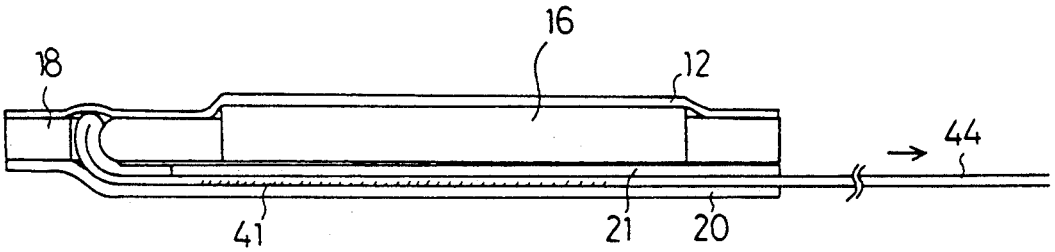
Figure 8:
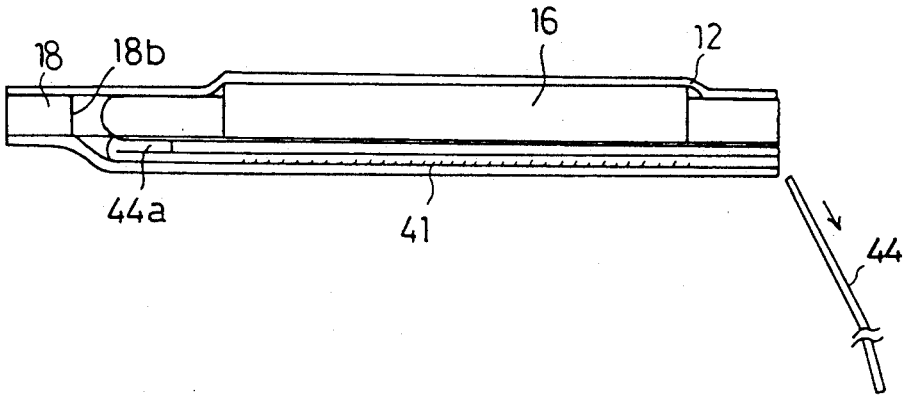

As shown in FIG. 8(*a*), the other end portion of the separator 44 projecting from the heat sensitive stencil 10 is pulled in a direction as depicted by an arrow to gradually remove an ink deposited portion 41 of the separator 44, and the portion 41 is disposed under the heat sensitive film 12 perforated. As shown in FIG. 8(*b*), when the ink deposited portion 41 is moved to reach a position between the two films 20 and 21, the separator 44 is completely removed from the space between the heat sensitive film 12 and the non-woven fabric 16. As the slit 18*b* of the frame 18 on the side of the opening 18*a* is chamfered, a load for pulling the separator 44 can be reduced to thereby prevent cutting of the separator 44 during the pulling operation. Finally, as shown in FIG. 8(*c*), the separator 44 is further pulled until it is stopped by an adhesive strength between the end portion 44*a* of the separator 44 and the frame 18. A distance between the slit 18*b* of the frame 18 and the non-woven fabric 16 is set so that the ink deposited portion 41 of the separator 44 in the condition shown in FIG. 8(*c*) is not exposed to the outside of the heat sensitive stencil 10, thereby preventing the ink deposited portion 41 touch the operator.

Further, the separator 44 may be formed with a cut line such as a perforation endurable against the pulling load to be applied to the separator 44, so that a pulled-out portion of the separator 44 projecting from the heat sensitive stencil 10 in the condition shown in FIG. 8(*c*) may be cut away along the cut line.

As described above, in the third preferred embodiment, even after the separator 44 is removed from the space between the heat sensitive film 12 and the non-woven fabric 16, the ink deposited portion 41 of the separator 44 is not exposed to the outside of the heat sensitive stencil 10. Therefore, the operator's hands are prevented from being stained by the ink deposited on the ink deposited portion 41 of the separator 44.

While advantageous embodiments have been chosen to illustrate the invention, it will be understood by those skilled in the art that various changes and modifications can be made therein without departing from the scope of the invention as defined in the appended claims.

What is claimed is:

1. A heat sensitive stencil having a side edge with a total thickness comprising:

heat sensitive means for forming a perforated image;

ink means for holding ink having a first thickness, and being located adjacent said heat sensitive means;

a frame with a second thickness having a first side and a second side, said first side and said second side being opposite to each other, said frame surrounding said ink means and being coupled to said heat sensitive means on said first side; and an ink impermeable base coupled to said frame on said second side, adjacent said ink means, wherein said first thickness is greater than said second thickness such that said ink means protrudes beyond said frame and beyond said total thickness of said side edge.

2. The heat sensitive stencil as in claim 1, wherein said heat sensitive means comprises a film laminate.

3. The heat sensitive stencil as in claim 1, wherein said heat sensitive means comprises a film laminate formed of a thermoplastic layer capable of being thermally perforated and a porous carrier bonded thereto.

4. The heat sensitive stencil as in claim 1, wherein said frame is adhesively secured to said heat sensitive means and said base.

5. The heat sensitive stencil as in claim 1, wherein said ink means comprises a non-woven fabric impregnated with ink.

6. The heat sensitive stencil as in claim 1, further comprising a removable separator disposed between said heat sensitive means and said ink means.

7. A heat sensitive stencil comprising:

heat sensitive means for forming a perforated image;

an ink impermeable base coupled to said heat sensitive means;

ink means for holding ink located between said heat sensitive means and said ink impermeable base; and an ink impermeable separator removably disposed between said heat sensitive means and said ink means, wherein said heat sensitive means, said ink impermeable base, said ink means and said separator form a sealed assembly.

8. The heat sensitive stencil as in claim 7, wherein said heat sensitive means comprises a film laminate formed of a thermoplastic layer capable of being thermally perforated and a porous carrier bonded thereto.

9. The heat sensitive stencil as in claim 7, wherein said ink means comprises a non-woven fabric impregnated with ink.

10. The heat sensitive stencil as in claim 7, further comprising a frame surrounding said ink means bonded between said heat sensitive means and said base.

11. The heat sensitive stencil as in claim 10, wherein said frame has a thickness less than a thickness of said ink means and said ink means protrudes beyond said frame toward said heat sensitive means.

12. The heat sensitive stencil as in claim 10, wherein said frame has a slit therein and said separator extends through said slit and forms a pull tab.

13. The heat sensitive stencil as in claim 12, wherein said slit has a chamfered edge.

14. The heat sensitive stencil as in claim 10, wherein said separator is coupled to said frame.

15. The heat sensitive stencil as in claim 7, wherein said separator also extends between said base and said ink means.

16. The heat sensitive stencil as in claim 7, wherein said base comprises two members and said separator also extends therebetween.

17. The heat sensitive stencil as in claim 7, wherein said separator has a frangible portion.

18. The heat sensitive stencil as in claim 7, wherein said separator is folded double between said heat sensitive means and said ink means.

19. The heat sensitive stencil as in claim 7, wherein said separator has a wetting angle of about 45° or more and is made from a material selected from the group consisting of resin film and releasing paper with silicon.

20. A heat sensitive stencil for printing an image and having a side edge, comprising:

a heat sensitive film for forming a perforated image therein;

an ink carrier member located adjacent said heat sensitive film;

a frame surrounding said ink carrier member, having a slit therein and being bonded to said heat sensitive film;

an ink impermeable base bonded to said frame on an opposite side than said heat sensitive film, adjacent said ink carrier member, wherein said heat sensitive film, said frame and said ink impermeable base form said side edge having a thickness and said ink carrier member and adjacent ink impermeable base have a combined thickness greater than said thickness of said side edge; and an ink impermeable separator removably disposed between said heat sensitive film and said ink carrier member and having an end extending through said slit in said frame thus forming a pull tab.

* * * * *